US005079802A

United States Patent [19]

Blase et al.

[11] Patent Number: 5,079,802

[45] Date of Patent: Jan. 14, 1992

[54] SUCTION HOSE ATTACHMENT CLIP AND VACUUM CLEANING DEVICE USING SAME

[75] Inventors: Michael R. Blase, Grand Rapids; Giovanni Pino, Kentwood, both of Mich.

[73] Assignee: Bissell Inc., Grand Rapids, Mich.

[21] Appl. No.: 566,835

[22] Filed: Aug. 13, 1990

[51] Int. Cl.[5] ..... A44B 21/00

[52] U.S. Cl. ..... 24/16 R; 24/16 PB; 24/339; 24/343

[58] Field of Search ..... 24/16 PB, 16 R, 329, 24/339, 336, 343, 20 CW, 20 S

[56] References Cited

U.S. PATENT DOCUMENTS

| | | | |
|---|---|---|---|
| 2,452,406 | 10/1948 | Volkery et al. | 24/329 |
| 2,637,475 | 5/1953 | Gialanella | 24/339 |
| 2,818,871 | 1/1958 | Beaudry | 24/16 PB |
| 3,893,647 | 7/1975 | Kennedy | 24/339 |
| 3,901,480 | 8/1975 | Basile et al. | 24/343 |
| 4,291,855 | 9/1981 | Schenkel et al. | 24/339 |
| 4,526,756 | 7/1985 | Wong | 24/16 PB |
| 4,837,899 | 6/1989 | Young | 24/339 |

*Primary Examiner*—Victor N. Sakran
*Attorney, Agent, or Firm*—Price, Heneveld, Cooper, DeWitt & Litton

[57] ABSTRACT

The present invention is a suction hose clip for connecting an accessory hose, an accessory cable or the like to the suction hose of a vacuum cleaning device. The clip is generally ring-shaped with an open side defining two opposing ends. The clip has an accessory receiving area positioned generally opposite to the open side. Oppositely facing hook portions are provided at the two opposing ends and engage with each other to provide a hook over hook closure to close the clip around a suction hose. A rib projects from the inner wall of the clip to engage the corrugated surface of a suction hose and keep the clip from sliding along the length of the suction hose.

3 Claims, 1 Drawing Sheet

SUCTION HOSE ATTACHMENT CLIP AND VACUUM CLEANING DEVICE USING SAME

BACKGROUND OF THE INVENTION

The present invention relates to accessories for surface cleaning devices, such as carpet extractors and vacuum cleaners, for example, which utilize a suction hose. Specifically, the present invention is a suction hose clip for clipping accessory tubes or cables to a suction hose, to minimize entanglements and enhance the utility of the cleaning device.

A commonly known hose clip is the generally C-shaped device which simply clips over a suction hose, has a tube or cord receiving recess in the inside back of the "C" and is typically made of a rigid plastic. Such a clip is often ineffective in keeping hoses and cables organized because the clip will often slide along the length of the hose, resulting in too much space between consecutive clips. Such clips are also easily damaged so they no longer clip to the suction hose. Further, the material of such clips is known to age, become brittle and lose its resilience and springiness so the clip no longer clips to the hose.

Alternatively, a rubbery strap having a tab through slot connection between its opposite ends has been known to be used for strapping an accessory cable or hose to a suction hose. As above, this arrangement also allows the fastener to slide along the length of the hose and allow excessive space between consecutive fastening points. Further, such strap fasteners are known to detach easily, defeating their purpose, and can lose their elasticity, degrading their utility.

SUMMARY OF THE INVENTION

The hose clip of the present invention is made of a resilient material for connecting an accessory tube, an accessory cable or the like with a suction hose. In one aspect of the invention, the clip has a hook over hook attachment between its opposing ends. In another aspect of the invention, an internal rib is provided for engaging the corrugation of a suction hose to preclude movement of the clip along the length of the hose.

DESCRIPTION OF THE PREFERRED EMBODIMENT

Figure 1:
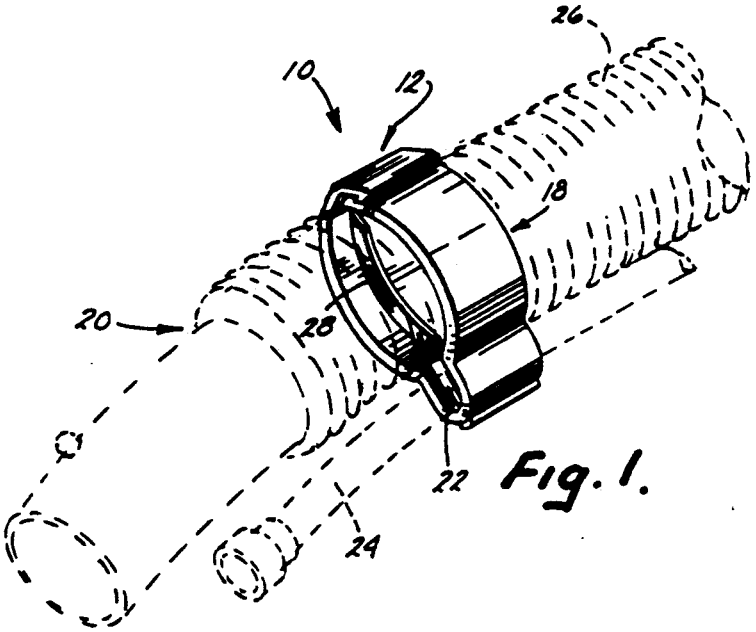
FIG. 1 is a perspective view of the clip of the present invention, with an accessory tube and a suction hose shown in phantom.
Figure 2:
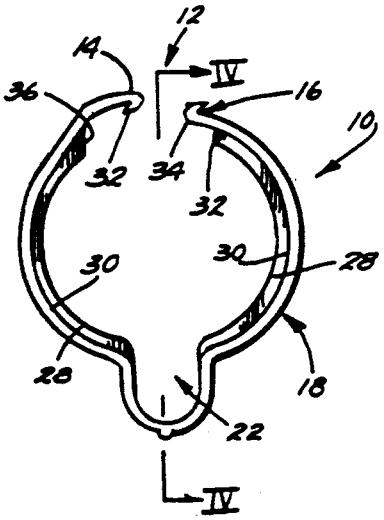
FIG. 2 is an end view of the clip of FIG. 1 in the open position.

Referring more specifically to the figures, hose attachment clip 10 of the present invention is generally ring-shaped with an open side 12 defining opposing ends 14 and 16. The clip 10 has a main body 18 for circumscribing a suction hose 20. An accessory receiving area 22 is formed in the main body 18 of the clip 10 for receiving an accessory tube 24, an accessory cable or the like.

The suction hose 20 has a generally corrugated surface 26, including a series of ridges and valleys for flexibility. The clip 10 has a rib 28 projecting inwardly from the inner wall 30 of the main body 18. The rib 28 preferably extends between a hook portion 32, formed at the end 14, and the receiving area 22 on one side and between a hook portion 34, formed at the end 16, and the receiving area 22 on the other side as generally shown in the figures. The rib 28 does not extend into the receiving area 22 so as not to interfere with the accessory tube 24, allowing the accessory tube 24 to slide freely within the receiving area 22.

The hose attachment clip 10 is preferably injection molded of a thermoplastic for resilience and durability. However, it will be apparent to those who practice the invention that a variety of different materials can be used with the durability and performance of the clip being subject to the material chosen.

The hook portion 32 is an inwardly facing hook and the hook portion 34 is an outwardly facing hook. The hooks 32 and 34 cooperatively engage each other to secure the clip 10 to the suction hose 20 as the clip 10 is squeezed to bring the ends 14 and 16 toward and past each other and the clip 10 is released, allowing the facing hooks 32 and 34 to engage.

Figure 3:
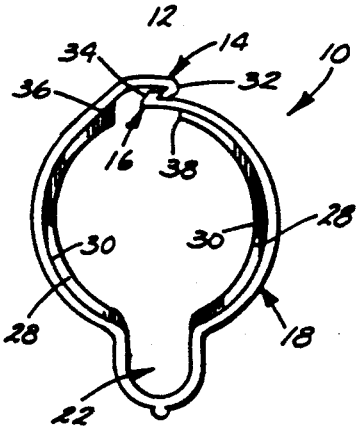
FIG. 3 an view of the clip of FIG. 1 in the closed position.
Figure 4:
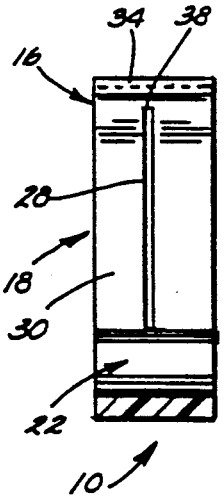
FIG. 4 is a sectional view along plane IV—IV of FIG. 2.

In use, the accessory tube 24 is placed in the receiving area 22 and the main body 18 is placed around the suction hose 20. The rib 28, projecting from the inner wall 30, engages a valley in the corrugated surface 26 of the suction hose 20. The clip 10 is squeezed to bring the hooks 32 and 34 toward and past each other with the hook 32 passing to the outside of the hook 34. The clip 10 is then released and the hooks engage as shown in FIG. 3. With the rib 28 engaging a valley in the corrugated surface 26, the clip 10 is precluded from moving along the length of the hose 20. An end 36 of the rib 28, near the hook 32, acts as a stop to the encroaching movement of the hook 34 as the clip 10 is squeezed as described above. Another end 38 of the rib 28, near the hook 34, serves the analogous function in the event that the relative position of the two hooks is reversed. Both ends 36 and 38 serve the purpose of minimizing the unlikely possibility of crushing the hose 20 by excessively squeezing the clip 10 during installation.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principals of patent law, including the doctrine of equivalence.

The embodiments of the invention in which an exclusive property or privilege is claimed are defined as follows:

1. In a vacuum cleaning device including a suction hose, said hose having a corrugated surface with a series of ridges and valleys formed thereon, a hose attachment clip for connecting at least one of an accessory tube and an accessory cable with said suction hose comprising:

a ring-shaped member formed of resilient material, said member having an inner wall with a recessed area formed in said inner wall for receiving said accessory and said member having an open side defining two opposing ends, said open side being spaced from said recessed area; and at least one rib for engaging one of said valleys upon said corrugated surface of said suction hose to keep said clip from sliding along the length of said suction hose, said rib projecting inwardly from said inner wall of said ring-shaped member and said rib extending along said inner wall between said recessed area and one of said two opposing ends.

2. The clip of claim 1 further including a cooperating clasping means on each of said two opposing ends for clasping said two opposing ends together.

3. The clip of claim 1 wherein said clasping means comprises a first hook portion at one of said two opposing ends, said first hook portion having an inwardly projecting barb member, and a second hook portion, inversely oriented to said first hook portion, at the other of said two opposing ends such that said hooks can engage each other and retain said clip in a closed position.

* * * * *